US009328884B2

(12) United States Patent
Yang

(10) Patent No.: US 9,328,884 B2
(45) Date of Patent: May 3, 2016

(54) AQUA-LAMP-BASED CANDLE-LIKE LIGHTING DEVICE

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 12 days.

(21) Appl. No.: 14/318,702

(22) Filed: Jun. 30, 2014

(65) Prior Publication Data

US 2015/0377434 A1 Dec. 31, 2015

(51) Int. Cl.

| | |
|---|---|
| ***F21S 10/00*** | (2006.01) |
| ***F21V 23/04*** | (2006.01) |
| ***F21V 29/00*** | (2015.01) |

(52) U.S. Cl.

CPC ..... *F21S 10/002* (2013.01); *F21V 23/04* (2013.01); *F21V 29/008* (2013.01)

(58) Field of Classification Search

CPC ..... F21S 10/002

See application file for complete search history.

(56) References Cited

U.S. PATENT DOCUMENTS 5,208,516 A * 5/1993 Saidian ..... F21V 19/006 307/116

2009/0135585 A1* 5/2009 Yang ..... F21S 10/002 362/101

* cited by examiner

*Primary Examiner* — Anne Hines

(74) *Attorney, Agent, or Firm* — Leong C. Lei

(57) ABSTRACT

An aqua-lamp-based candle-like lighting device includes a stand, an aqua-lamp and a seat. The stand and seat are positioned at a bottom and a top of the aqua-lamp respectively. A control circuit, installed inside the stand, has a heating element by resistance from electricity and an illuminator. The aqua-lamp is in a three-dimensional hollow shape of transparent appearance containing a low boiling temperature fluid in a dense state with a bottom adhered to the heating element. The seat is provided with a receiving port for accommodating a candle. Thereby the low boiling temperature fluid is in a flowing state by contacting a heat source and under lighting by the illuminator when electricity is applied to the stand and the heating element is operating by resistance so as to enhance the decorating effectiveness.

9 Claims, 10 Drawing Sheets

AQUA-LAMP-BASED CANDLE-LIKE LIGHTING DEVICE

TECHNICAL FIELD OF THE INVENTION

The present invention is related to a candle stand, particularly a decorative candle-like lighting device for enhancing visual sensation through furnishings within an environment.

DESCRIPTION OF THE PRIOR ART

For a long period of time the application of a traditional candle is extended from a simple illumination to either celebration, sacrifice, decoration or a specific ambience in both western and eastern states. The traditional candle becomes a necessary article in daily life because of the broad range of application and functionality.

Usually a candle stand utilizes various appearances to achieve a pleasing sensation through visual effect. However such candle stand of the prior art can only display a visual effect in a static mode and cannot further illustrate a visual effect with dynamic changes that is the deficiency of the candle stand of the prior art.

SUMMARY OF THE INVENTION

An objective of the present invention is to resolve the deficiency of the candle stand of the prior art for enhancing the variety of visual sensation.

Therefore the present invention is to provide an aqua-lamp-based candle-like lighting device primarily includes a stand, which is with an upward opening and a control circuit, as installed inside the stand, consisting of at least a heating element for producing heat by resistance from application of electricity and an illuminator facing toward the opening;

An aqua-lamp, which is positioned at a top of the stand with a bottom adhered to the heating element, in a three-dimensional hollow shape of transparent appearance with a sealed internal space for containing a low boiling temperature fluid in a dense state; and A seat, which is positioned at a top of the aqua-lamp and provided with a receiving port for accommodating a candle.

The advantage of the present invention is to utilize the heating element for producing heat by resistance from the application of electricity as a heat source in order to make the low boiling temperature fluid contained inside the aqua-lamp into a flowing state under the lighting of the illuminator. Thereby the present invention can enhance the decorating effectiveness.

DETAILED DESCRIPTION OF THE PREFERRED EMBODIMENTS

Figure 1:
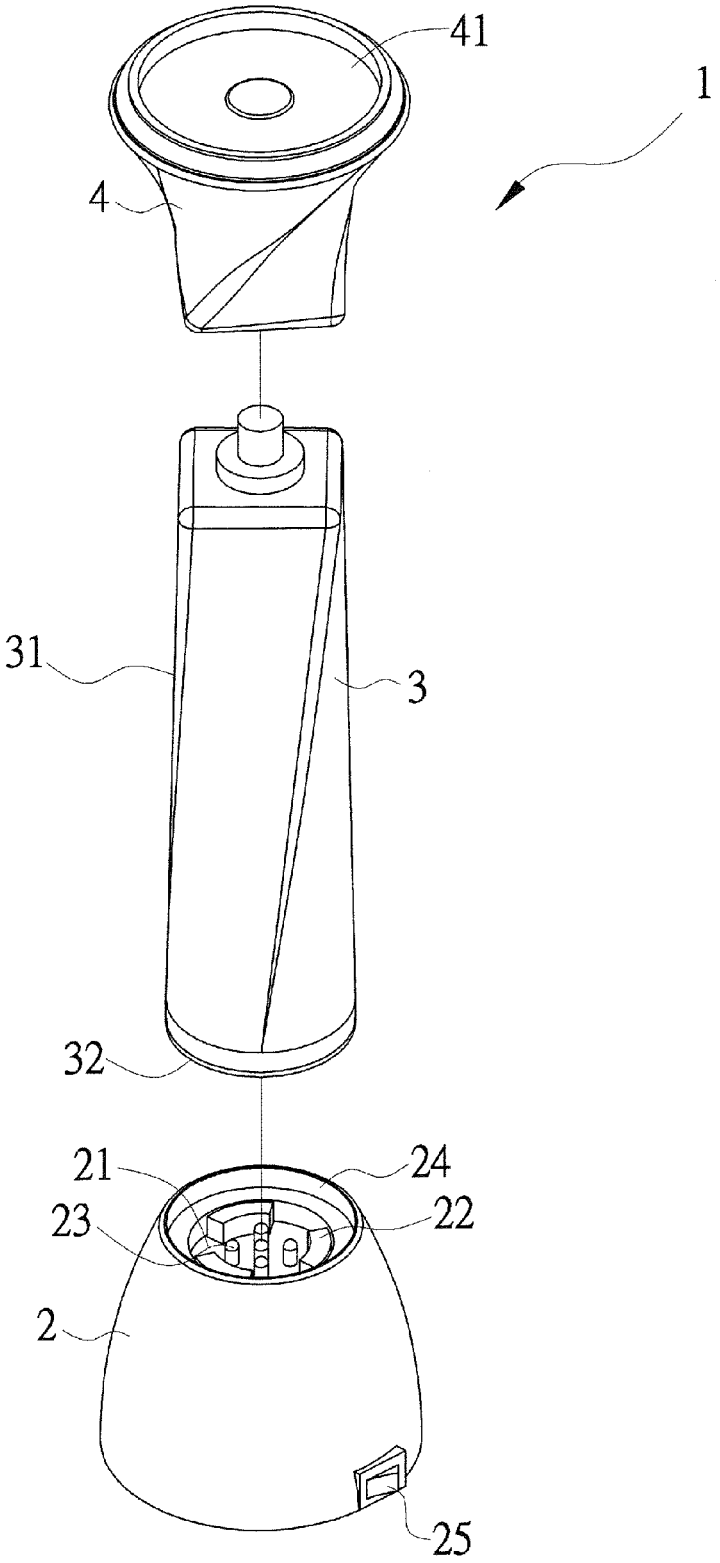
FIG. 1 is a disassembly diagram illustrating the present invention.
Figure 2:
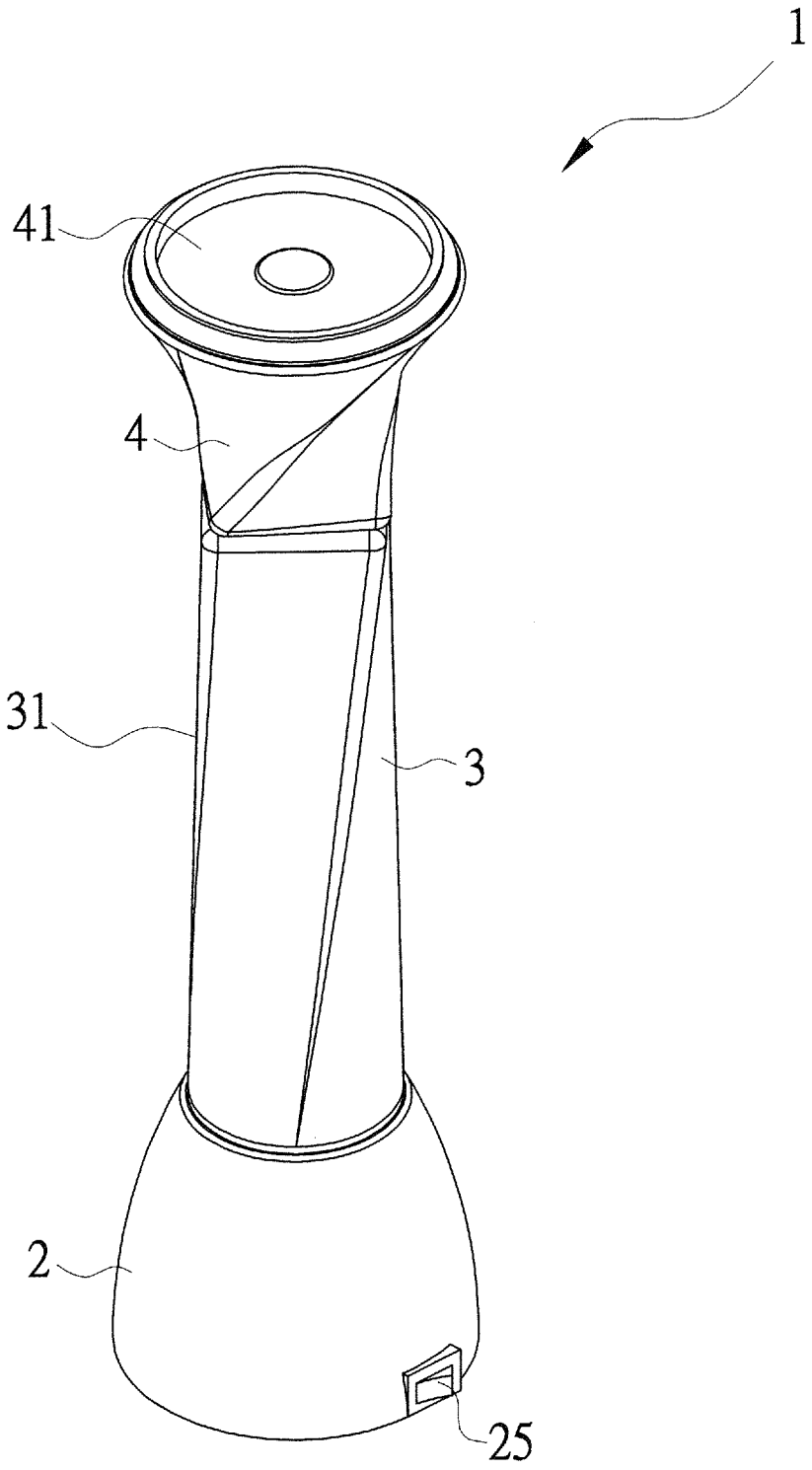
FIG. 2 is an assembly diagram illustrating the present invention.
Figure 3:
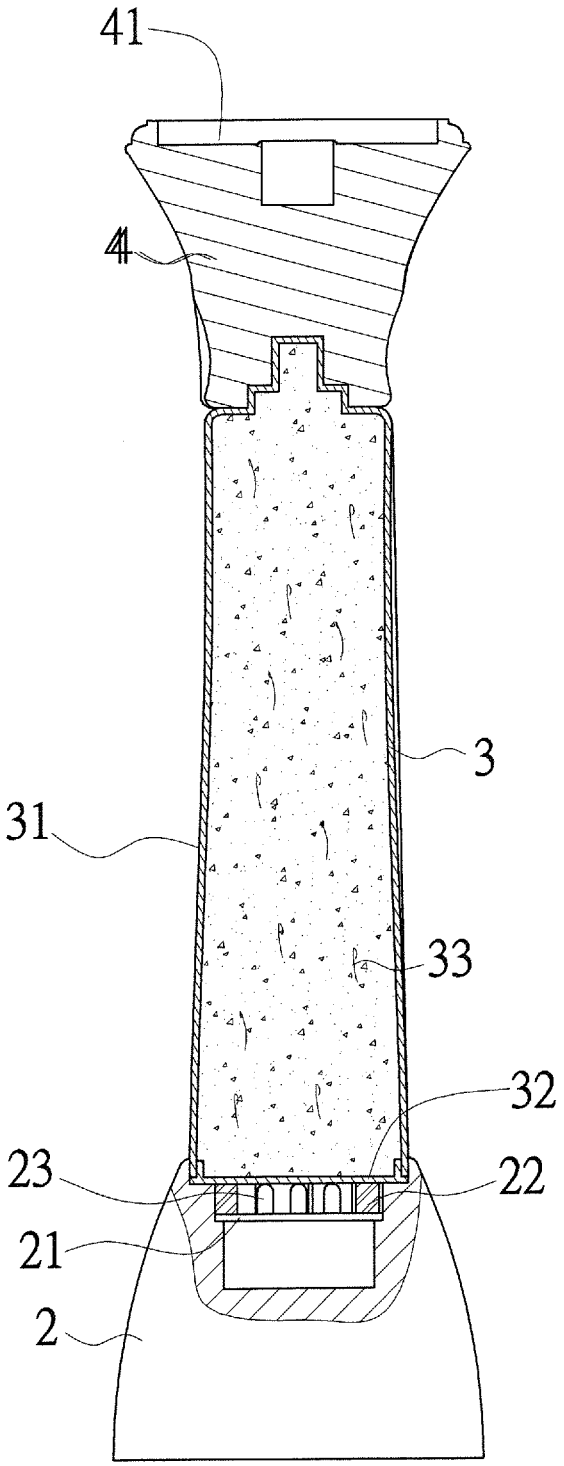
FIG. 3 is a cross-section diagram illustrating the present invention.
Figure 3A:
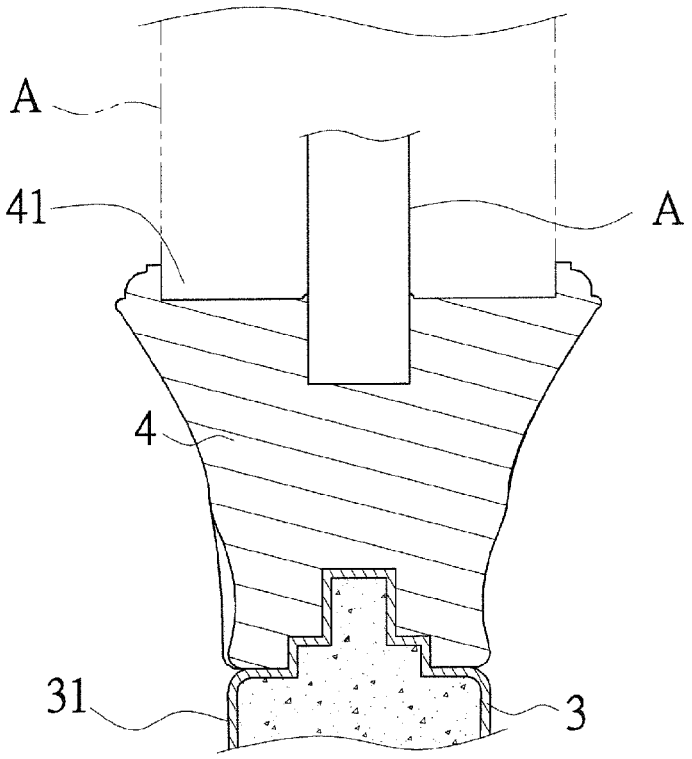
FIG. 3*a*, 3*b* are local amplification diagrams of FIG. 3.
Figure 3B:
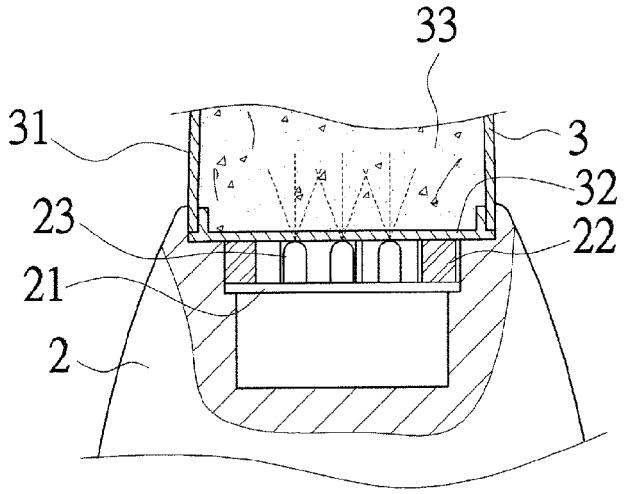

Please refer FIG. 1 to FIG. 3 illustrating a disassembly, assembly and cross-section diagrams of a preferred embodiment in operation for an aqua-lamp-based candle-like lighting device of the present invention. The lighting device (1) primarily includes a stand (2), an aqua-lamp (3) and a seat (4).

The stand (2) has an upward opening (24) and a control circuit (21) installed inside. The control circuit (21) consists of at least a heating element (22), which is able to produce heat by resistance effect with an application of electricity, and an illuminator (23). The heating element (22) can be selected from an ordinary resistor, cement resistor, electrical heating wire or electrical heating sheet that can produce heat by applying electricity. The illuminator (23) can be one of a LED, C7 light-bulb or the like, which can produce a light for illumination purpose by applying electricity, that the illuminator (23) is facing toward the opening (24). The stand (2) is further provided with a switch (25) for controlling the control circuit (21), which can be used to control a frequency of turning the light on and off as well as changing its color. The quantity of the illuminator (23) in the aforesaid embodiment varies according to the size of the aqua-lamp (3) that the quantity shown in the cited figures is merely for illustration instead of limitation.

According to the above-mentioned, the switch (25) can be a manual type as shown in FIG. 1 or a touch type. When the switch (25) is a touch type, the stand (2) is made of a metal substance. The principle of the touch type switch is a typical application of ordinary electric components such that the description of the touch type switch is omitted hereinafter.

The aqua-lamp (3) is positioned at a top of the stand (2) and has a bottom, which is adhered to the heating element (22), a three-dimensional hollow casing (31), which is made of transparent substance, and a transparent lid (32) that the lid (32) is adhered to the heating element (22). In this preferred embodiment the casing (31) is in a column shape for illustration instead of limitation that a low boiling temperature fluid (33) (such as dichloromethane, calcium nitrate or the like) is contained within a sealed internal space inside which either sequins or glittering powder is filled as well.

The seat (4) is positioned at a top of the aqua-lamp (3) and provided with a receiving port (41) for accommodating a candle (A). A cross-section of the receiving port (41) is in a cascade form for accommodating the candle (A) of different diameters. In this embodiment the seat (4) is in a bottom-up divergent shape for illustration instead of limitation on the appearance of the seat (4). Further the aqua-lamp (3) can be assembled to the seat (4) by an adhesive, screws or embedding that a securing method for assembling the seat (4) is within the scope of the present invention.

Thereby the heating element (22) is producing heat by resistance effect when the switch (25) of the stand (2) is turned on to apply an electricity that the low boiling temperature fluid (33) within the aqua-lamp (3) is flowing by contacting a heat source while the illuminator (23) is emitting light onto the fluid (33). Under the combination of the flowing fluid (33) and lighting by the illuminator (23), the present invention can achieve a brilliant visual sensation so as to enhance the decorating effectiveness.

Figure 4:
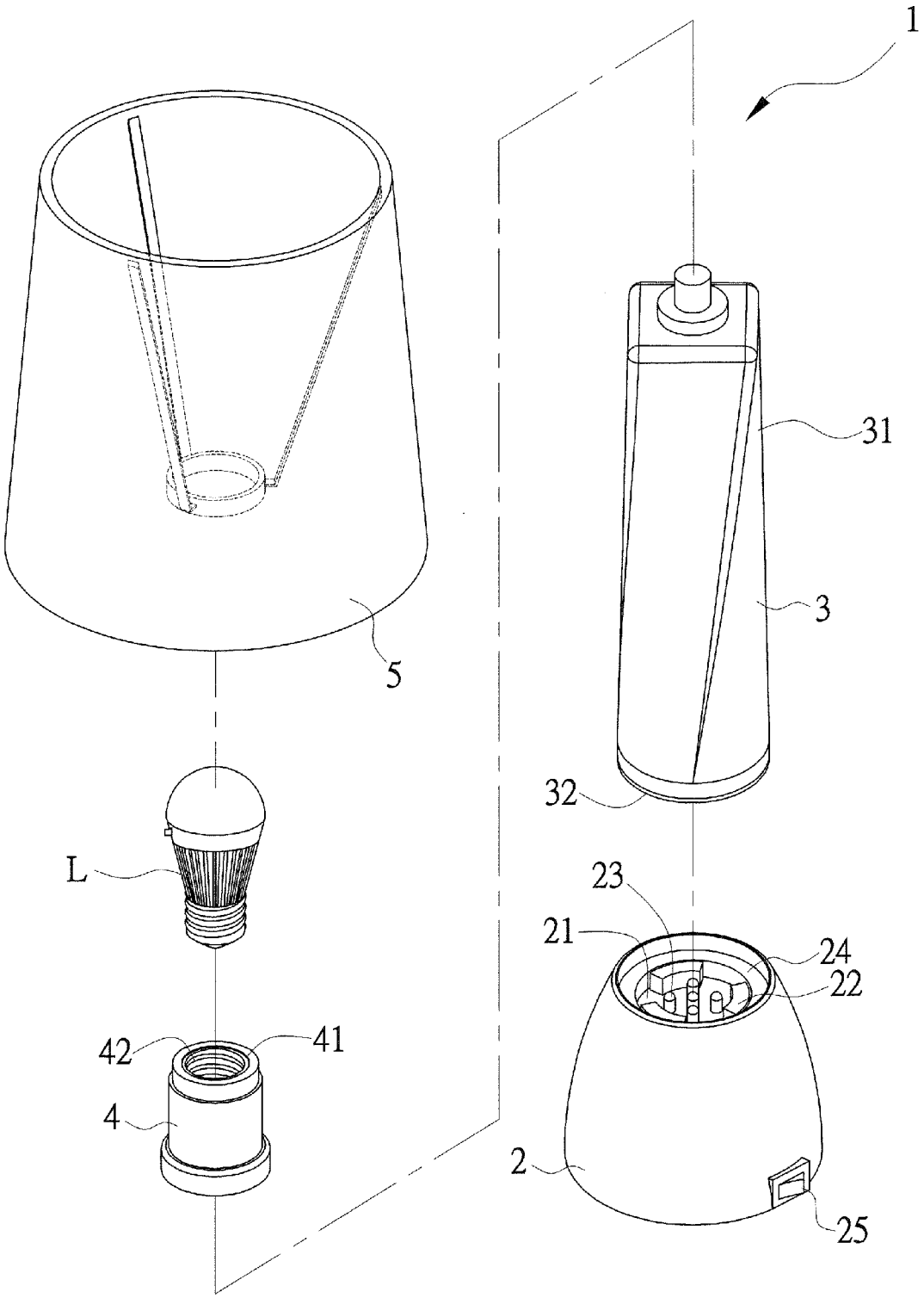
FIG. 4 is a disassembly diagram n illustrating a preferred embodiment incorporating a light-bulb and a mask of the present invention.
Figure 5:
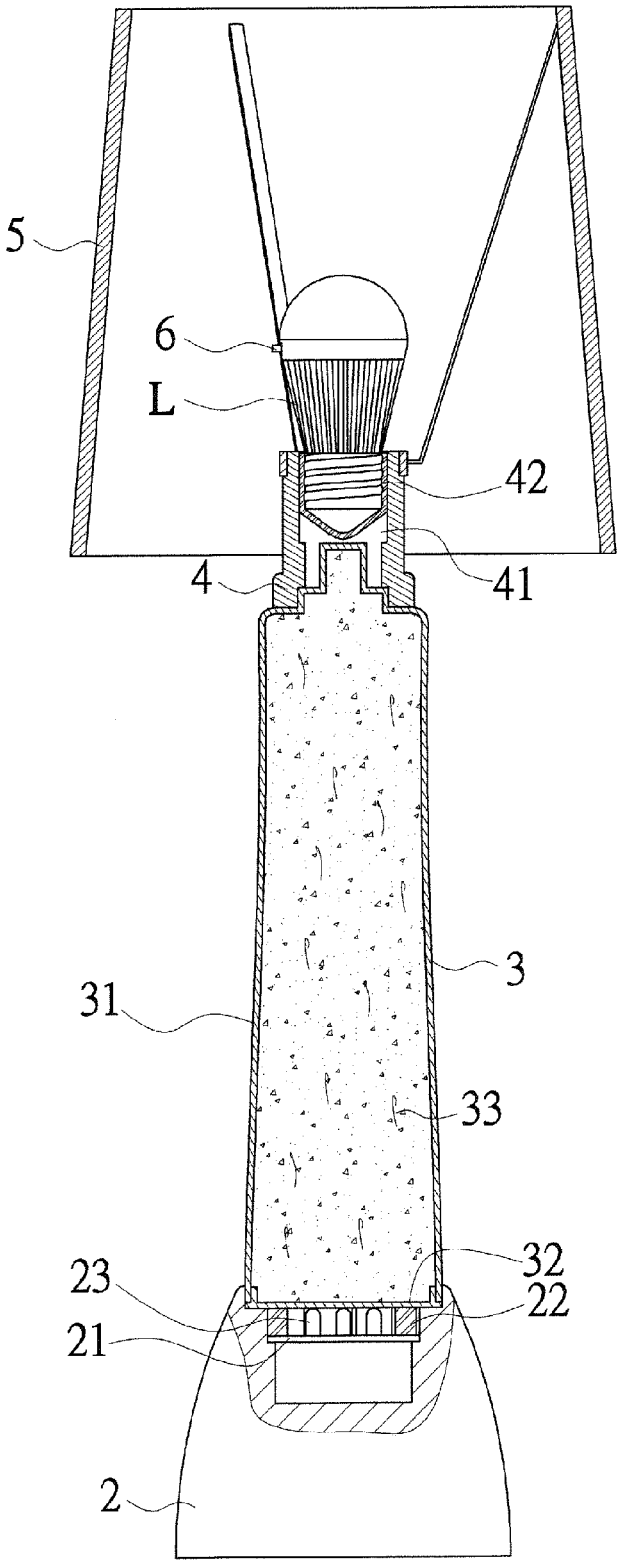
FIG. 5 is a cross-section diagram of FIG. 4.
Figure 6:
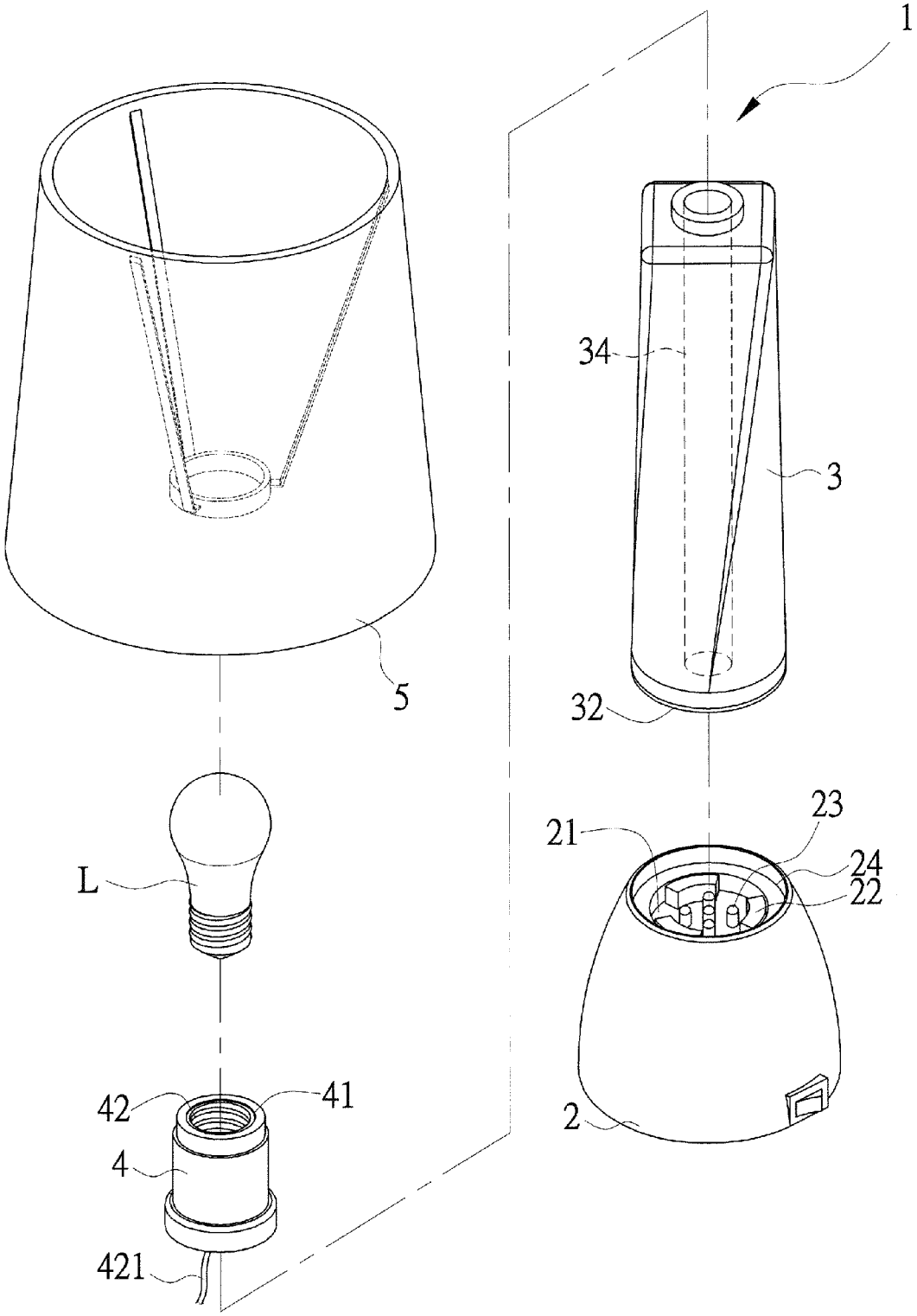
FIG. 6 is a disassembly diagram illustrating the preferred embodiment of the present invention.
Figure 7:
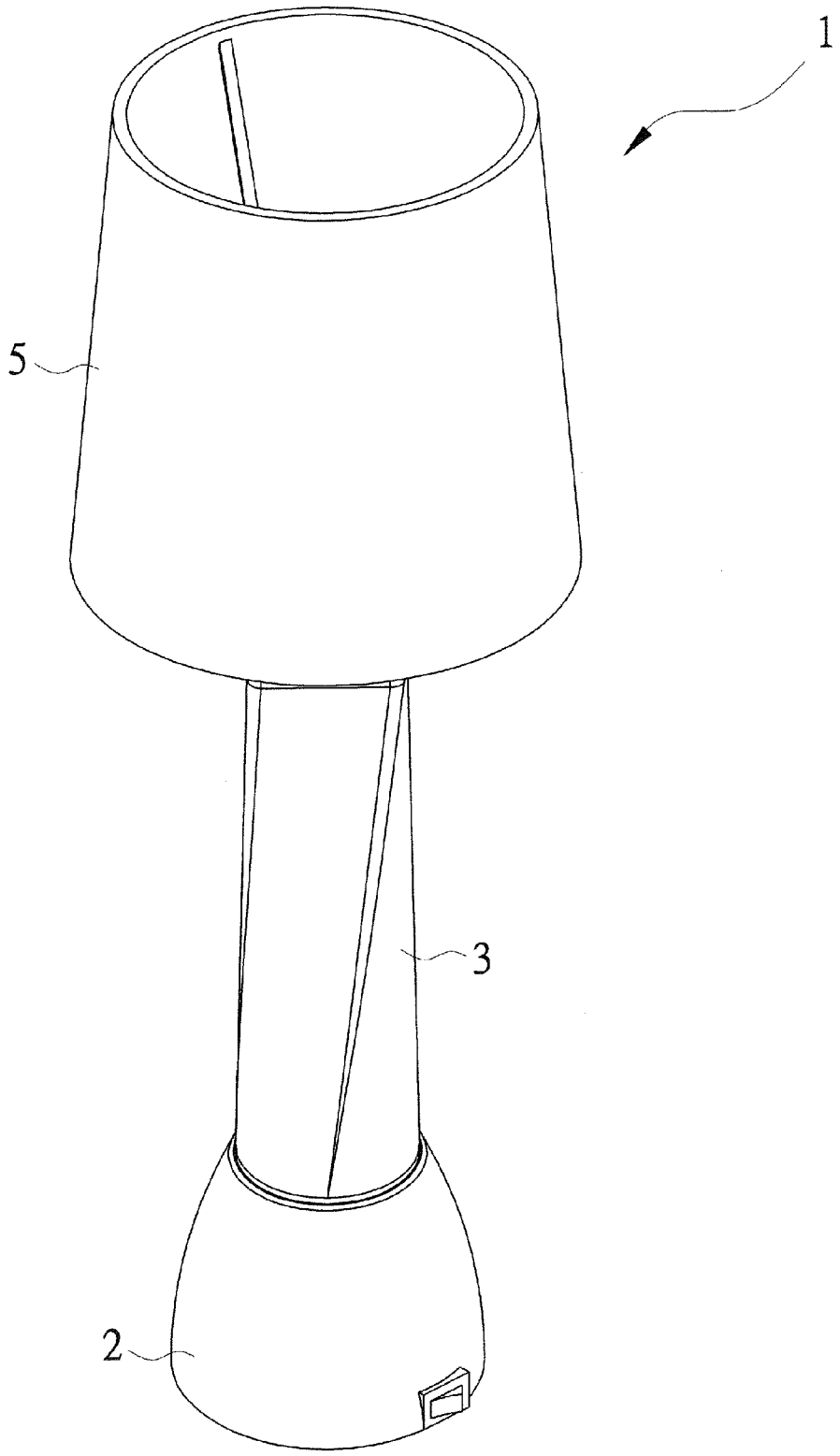
FIG. 7 is an assembly diagram illustrating the preferred embodiment of the present invention.
Figure 8:
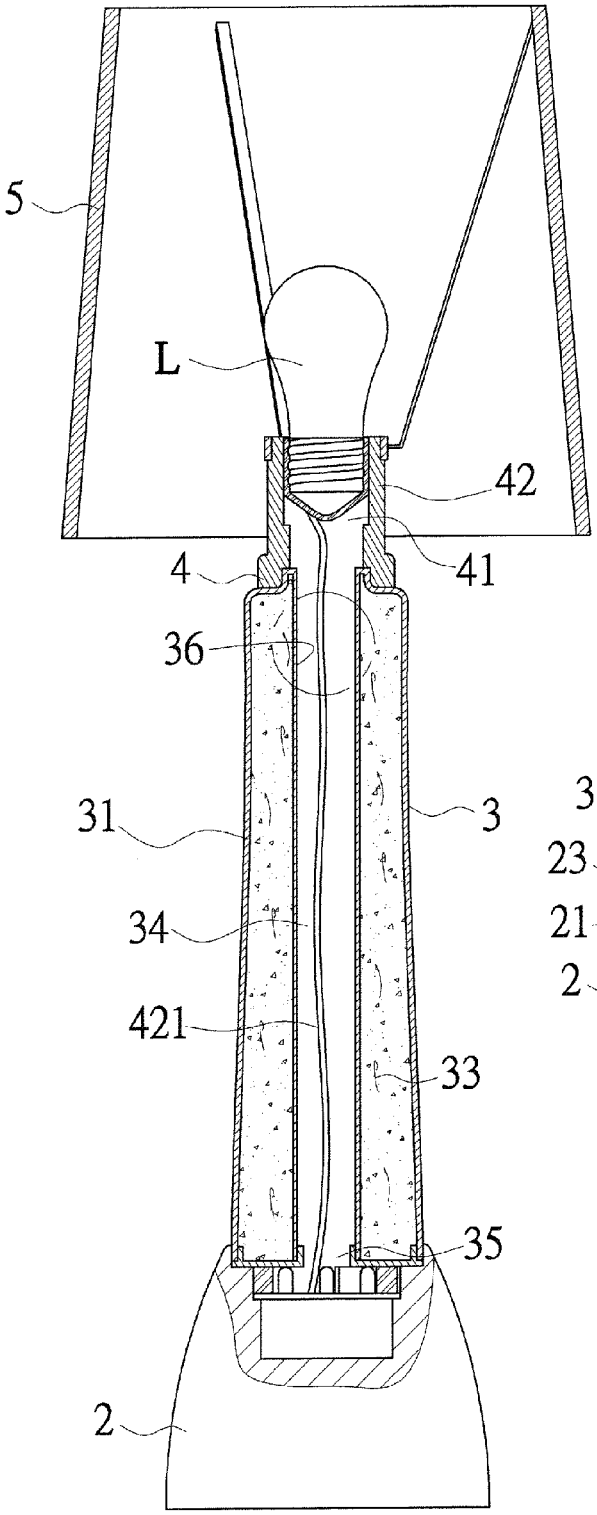
FIG. 8 is a cross-section diagram of FIG. 7.
Figure 8A:
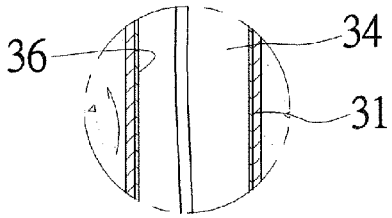
FIG. 8*a*, 8*b* are local amplification diagrams of FIG. 8.
Figure 8B:
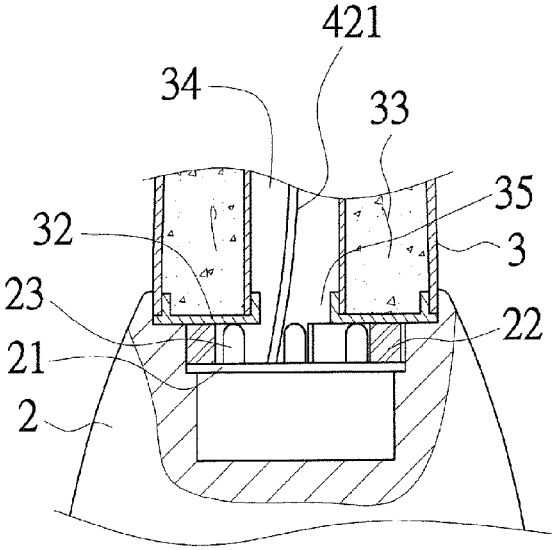

Please refer FIGS. 4 and 5 illustrating a disassembly and cross-section diagrams of an embodiment incorporating a light-bulb and a mask of the present invention. A light-bulb socket (42) is provided inside the receiving port (41) of the seat (4) for accommodating a light-bulb (L) and a mask (5) is positioned at a circumference of the seat (4). The light-bulb (L) can be either an incandescent type or a LED type that the LED light-bulb is used herewith for illustration. A switch (6) is further provided at the light-bulb (L) in this embodiment for controlling the on-off of the light-bulb (L) and can be located at the light-bulb socket (42) as well. Thus the present invention constitutes a desktop-light through the above-mentioned.

Please refer FIGS. 6 to 9*a* illustrating an embodiment incorporating an incandescent light-bulb of the present invention. The primary structure is the same as the above-mentioned and the difference is described hereinafter. A passage (34) is provided inside the casing (31) of the aqua-lamp (3) from top to bottom and the lid (32) is provided with a hole (35), which is connected with the passage (34). The light-bulb socket (42) includes a wire (421) passing through the passage (34) and the hole (35) to be connected to the control circuit (21) that the switch (25) is used to control the on-off of the light-bulb (L). An exterior of the passage (34) is provided with a decoration layer (36), which can be selected from the existing methods such as stickers, painting, grit-blasting and so on. A main objective is to decorate the aqua-lamp (3) and cover the wire (421) of the light-bulb socket (42) so as to generate a visual variation in multiply layers from the passage (34), the fluid (33) and the sequins or glittering powder within the aqua-lamp (3).

Figure 9:
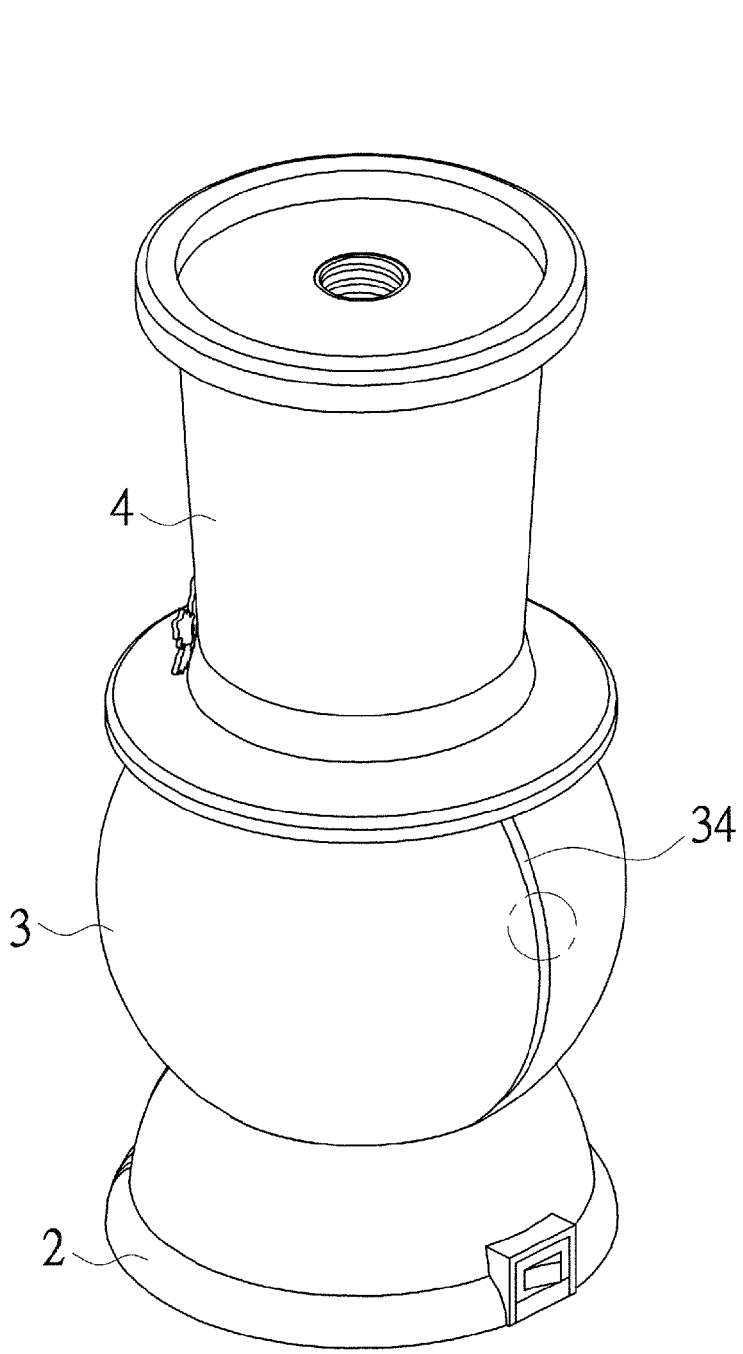
FIG. 9 is a three-dimensional perspective diagram illustrating the preferred embodiment of the present invention.
Figure 9A:
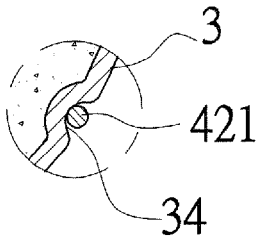
FIG. 9*a* is a local cross-section amplification diagram of FIG. 9.

The other embodiment of the present invention is shown in FIGS. 9 and 9*a*. The difference of this embodiment from the above-mentioned is that the passage (34) is provided along an outer edge of the aqua-lamp (3) from top to bottom while the wire (421) is positioned inside the passage (34).

I claim:

1. An aqua-lamp-based candle-like lighting device comprising:

a stand with an upward opening and a control circuit installed inside, the control circuit comprising at least a heating element by resistance from electricity and an illuminator facing toward the opening, the heating element and the illuminator being separate from each other to respectively give off heat and light;

an aqua-lamp, which is positioned at a top of said stand and has a bottom in contact engagement with the heating element, said aqua-lamp in a three-dimensional hollow shape of transparent appearance with a sealed internal space for containing a liquid having a predetermined boiling temperature in a state of being flowable in the sealed internal space; and a seat positioned on a top of said aqua-lamp and provided with a receiving port for accommodating a light source;

wherein the heating element produces heat through resistance effect, the heat being directly transmitted through the bottom of the aqua-lamp through the contact engagement therebetween to heat the liquid for causing the liquid to flow in the sealed internal space of the aqua-lamp, and the illuminator produces light that is transmitted through the bottom of the aqua-lamp and travels through the liquid that is heated to flow in the sealed internal space of the aqua-lamp.

2. The aqua-lamp-based candle-like lighting device of claim 1 wherein the heating element is one of a cement resistor, electrical heating wire or electrical heating sheet.

3. The aqua-lamp-based candle-like lighting device of claim 1 wherein the receiving port of said seat is provided with a light-bulb socket for an installation of a light-bulb.

4. The aqua-lamp-based candle-like lighting device of claim 3 wherein said aqua-lamp is further provided with a passage from top to bottom while the light-bulb socket includes a wire passing through the passage to be connected to the control circuit.

5. The aqua-lamp-based candle-like lighting device of claim 4 wherein an exterior of the passage is provided with a decoration layer.

6. The aqua-lamp-based candle-like lighting device of claim 3 wherein further includes a mask positioned at a circumference of said seat.

7. The aqua-lamp-based candle-like lighting device of claim 1 wherein said seat is provided with a switch for controlling the control circuit.

8. The aqua-lamp-based candle-like lighting device of claim 7 wherein the switch is a touch type switch.

9. The aqua-lamp-based candle-like lighting device of claim 3 wherein further includes a switch for turning on and off the light-bulb.

* * * * *